US008965255B2

(12) United States Patent
Nakae

(10) Patent No.: US 8,965,255 B2
(45) Date of Patent: Feb. 24, 2015

(54) IMAGE FORMING APPARATUS WITH COLOR SLIPPAGE CORRECTION

(71) Applicant: KYOCERA Document Solutions Inc., Osaka (JP)

(72) Inventor: Sadanori Nakae, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 93 days.

(21) Appl. No.: 13/802,058

(22) Filed: Mar. 13, 2013

(65) Prior Publication Data

US 2013/0243452 A1 Sep. 19, 2013

(30) Foreign Application Priority Data

Mar. 14, 2012 (JP) ..... 2012-057255

(51) Int. Cl.
*G03G 15/01* (2006.01)
*G03G 15/00* (2006.01)
*G03G 15/16* (2006.01)

(52) U.S. Cl.
CPC ..... *G03G 15/011* (2013.01); *G03G 15/0189* (2013.01); *G03G 15/55* (2013.01); *G03G 15/1615* (2013.01); *G03G 15/5008* (2013.01); *G03G 2215/0158* (2013.01)
USPC ..... 399/301; 399/44

(58) Field of Classification Search
USPC ..... 399/44, 301
See application file for complete search history.

(56) References Cited

U.S. PATENT DOCUMENTS

| | | | | |
|---|---|---|---|---|
| 7,702,268 | B2 * | 4/2010 | Suzuki | 399/301 |
| 7,941,083 | B2 * | 5/2011 | Suzuki | 399/301 |
| 7,965,428 | B2 * | 6/2011 | Akamatsu | 358/518 |
| 8,010,026 | B2 * | 8/2011 | Kobayashi et al. | 399/301 |

FOREIGN PATENT DOCUMENTS

| | | | |
|---|---|---|---|
| JP | 08286566 | A | 11/1996 |
| JP | 2009115911 | A | 5/2009 |
| JP | 2009145400 | A | 7/2009 |
| JP | 2009217067 | A | 9/2009 |
| JP | 2010102122 | A | 5/2010 |

* cited by examiner

*Primary Examiner* — Sandra Brase
(74) *Attorney, Agent, or Firm* — Alleman Hall McCoy Russell & Tuttle LLP

(57) ABSTRACT

Image forming apparatus corrects for color slippage in toner image of a plurality of colors that have been sequentially transferred onto moving transfer target from the plurality of respective image carriers. A temperature of an interior of image-developing device is detected by first detection part, and a temperature of an interior of exposure device is detected by second detection part. First determination part determines whether or not the correction with respect to color slippage during temperature elevation is to be carried out, on the basis of first temperature detected by first detection part and second temperature detected by first detection part earlier than first temperature. Second determination part determines whether or not the correction with respect to color slippage during temperature decrease is to be carried out, on the basis of third temperature detected by second detection part and fourth temperature detected by second detection part earlier than third temperature.

3 Claims, 5 Drawing Sheets

IMAGE FORMING APPARATUS WITH COLOR SLIPPAGE CORRECTION

INCORPORATION BY REFERENCE

This application is based upon and claims the benefit of priority from the corresponding Japanese Patent Application No. 2012-057255 filed on Mar. 14, 2012, the entire contents of which are incorporated herein by reference.

BACKGROUND

The present disclosure relates to an image forming apparatus that transfers a toner image of a plurality of colors onto a moving transfer target, more specifically, relates to an image forming apparatus capable of correcting a color slippage that occurs in the toner image of a plurality of colors that have been transferred onto the transfer target.

An electrographic image forming apparatus is provided with a plurality of image forming units that form toner images of different colors. The image forming units each form a toner image on the surface of the photosensitive drum using an image-developing device, and transfers the toner image onto an endless transfer belt which is the transfer target. The plurality of image forming units sequentially transfer the toner images onto the transfer belt, thereby a color image, in which each of the toner images is superimposed, is formed on the transfer belt. The color image transferred onto the transfer belt is secondarily transferred onto the printing paper by a secondary transfer mechanism, and is subsequently fixed onto the printing paper by being subjected to pressure by a fuser roller which has been heated to 200° C. or higher in the fuser device.

In this type of image forming apparatus, when a temperature of an interior of the image forming apparatus changes, each of the members provided in the image forming apparatus expands and contracts. Such expansion and contraction causes inconsistencies in the movement speed of the transfer belt. These inconsistencies in the movement speed cause a difference between the movement amount of the transfer belt and the movement amount of the photosensitive drum. As a result, when the toner images on the photosensitive drum are sequentially transferred onto the transfer belt, the transfer timing of each of the toner images shifts, causing color slippage. Such color slippage is possible to correct using a well-known color slippage adjustment method. In the color slippage adjustment method, the temperature of the interior of the image forming apparatus is detected using a temperature sensor, and color slippage adjustment is performed at a timing determined on the basis of the temperature change amount.

SUMMARY

In an image forming apparatus according to one aspect of the present disclosure, the image forming apparatus includes a plurality of image carriers, an exposure device, an image-developing device, a correction part, a first detection part, a second detection part, a first determination part, and a second determination part. The plurality of image carriers are arranged in parallel on the interior of the image forming apparatus. The exposure device exposes the plurality of respective image carriers. The image-developing device forms a toner image on the plurality of respective image carriers which have been exposed using the exposure device. The correction part corrects for color slippage in the toner image of a plurality of colors that have been sequentially transferred onto a moving transfer target from the plurality of respective image carriers. The first detection part detects a temperature of an interior of the image-developing device. The second detection part detects a temperature of an interior of the exposure device. The first determination part determines whether or not the correction with respect to color slippage during temperature elevation is to be carried out, on the basis of a first temperature detected by the first detection part and a second temperature detected by the first detection part earlier than the first temperature. The second determination part determines whether or not the correction with respect to color slippage during temperature decrease is to be carried out, on the basis of a third temperature detected by the second detection part and a fourth temperature detected by the second detection part earlier than the third temperature.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

An embodiment of the present disclosure will be described in detail below with reference to the drawings. The embodiment described below is merely a specific example of the image forming apparatus in the present disclosure, and the image forming apparatus according to the present disclosure is not to be interpreted as being limited thereto.

Figure 1:
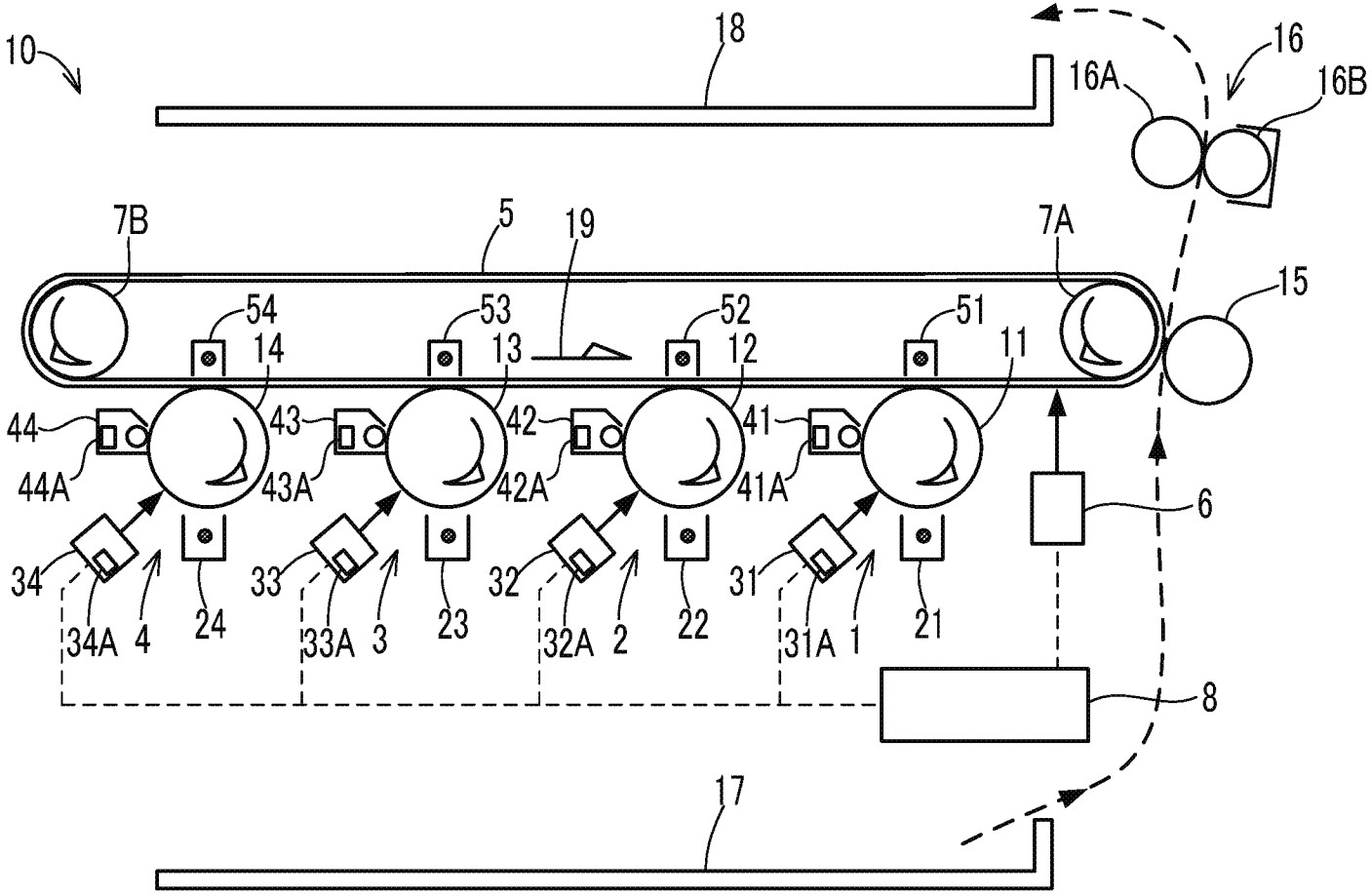
FIG. 1 is a view showing a schematic configuration of the image forming apparatus of an embodiment according to the present disclosure.

FIG. 1 is a view showing a schematic configuration of an image forming apparatus 10 according to the present embodiment. The image forming apparatus 10 is an example of the image forming apparatus in the present disclosure. As shown in FIG. 1, the image forming apparatus 10 is a so-called tandem-type color image forming apparatus. The image forming apparatus 10 includes a plurality of image forming parts 1 to 4, an intermediate transfer belt 5, a resist detection sensor 6, a drive roller 7A, a driven roller 7B, a secondary transfer device 15, a fuser device 16, a control unit 8, a paper feed tray 17, a paper output tray 18, and a temperature sensor 68 (see FIG. 2). The intermediate transfer belt 5 is an example of the transfer target in the present disclosure. The temperature sensor 68 is an example of the third detection part in the present disclosure. The specific example of the image forming apparatus 10 according to the present embodiment, for example, is a printer, a copying machine, a facsimile, or a multifunction machine provided with each of these functions.

The image forming parts 1 to 4 are electrographic image forming parts which form toner images of different colors on the plurality of respective photosensitive drums 11 to 14 arranged in parallel, and sequentially superimpose and transfer the toner images onto the running (moving) intermediate transfer belt 5. The plurality of photosensitive drums 11 to 14 are an example of the image carriers in the present disclosure. In the example shown in FIG. 1, an image forming part 1 for black, an image forming part 2 for yellow, an image forming part 3 for cyan, and an image forming part 4 for magenta are arranged in one line in this order from the downstream side of the movement direction (the direction shown by arrow 19) of the intermediate transfer belt 5.

The respective image forming parts 1 to 4 are provided with the photosensitive drums 11 to 14, charge devices 21 to 24, exposure devices 31 to 34, image-developing devices 41 to 44, and primary transfer devices 51 to 54. The exposure devices 31 to 34 are an example of the exposure device in the present disclosure. The image-developing devices 41 to 44 are an example of the image-developing device in the present disclosure. The photosensitive drums 11 to 14 carry the toner images. The charge devices 21 to 24 charge the surfaces of the photosensitive drums 11 to 14. The exposure devices 31 to 34 write electrostatic latent images onto the surfaces of the photosensitive drums 11 to 14 by exposing and scanning the surfaces of the charged photosensitive drums 11 to 14 with light. The image-developing devices 41 to 44 develop the electrostatic latent images on the photosensitive drums 11 to 14 using toner. The primary transfer devices 51 to 54 transfer the toner images on the photosensitive drums 11 to 14, which are rotated, onto the moving intermediate transfer belt 5. While not shown in FIG. 1, the respective image forming parts 1 to 4 are also provided with a cleaning device that removes the toner images that remain on the photosensitive drums 11 to 14.

The respective image-developing devices 41 to 44 are provided with temperature sensors 41A to 44A which can detect the temperature inside the image-developing devices 41 to 44. The control unit 8 monitors the temperatures inside the image-developing devices 41 to 44 detected from the temperature sensors 41A to 44A. Accordingly, the control unit 8 estimates the state of the toner present in the image-developing devices 41 to 44 on the basis of the temperatures, and controls the voltage supplied to the image-developing devices 41 to 44 such that the potential thereof is optimal for the toner.

The respective exposure devices 31 to 34 are provided with temperature sensors 31A to 34A which can detect the temperatures inside the exposure devices 31 to 34. The control unit 8 monitors the temperatures inside the exposure devices 31 to 34 detected from the temperature sensors 31A to 34A. Accordingly, the control unit 8 determines whether polygon motors present in the exposure devices 31 to 34 have reached an excessively high temperature or not, hence in an abnormal state, on the basis of the temperature.

The intermediate transfer belt 5, for example, is an annular belt formed from rubber or urethane. The intermediate transfer belt 5 is supported by the drive roller 7A and the driven roller 7B such that it may be rotatably driven. The drive roller 7A is arranged in a position close to the fuser device 16 (the right hand side in FIG. 1). The driven roller 7B is arranged in a position distanced from the fuser device 16 (the left hand side in FIG. 1). The surface of the drive roller 7A is formed from a material such as rubber or urethane in order to increase the frictional force with the intermediate transfer belt 5. The intermediate transfer belt 5 is supported by the drive roller 7A and the driven roller 7B, therefore the intermediate transfer belt 5 can move (run) while the surface thereof is in contact with the respective surfaces of the photosensitive drums 11 to 14. The toner images from the respective photosensitive drums 11 to 14 are transferred and superimposed on top of one another in order onto the intermediate transfer belt 5 when the surface thereof passes between the photosensitive drums 11 to 14 and the primary transfer devices 51 to 54.

The secondary transfer device 15 transfers the toner image, which has been transferred onto the intermediate transfer belt 5, onto the printing paper that has been transported from the paper feed tray 17 to the secondary transfer device 15. The printing paper to which the toner image has been transferred is transported to the fuser device 16 by a transporting part (not shown). The fuser device 16 includes a heating roller 16A heated to approximately 200° C. or higher, and a pressure roller 16B arranged to oppose the heating roller 16A. The printing paper transported to the fuser device 16 is transported while being pinched by the heating roller 16A and the pressure roller 16B. Accordingly, the toner image on the printing paper is fused to the printing paper. The printing paper is subsequently output to the paper output tray 18.

The temperature sensor 68 (see FIG. 2) can detect the exterior temperature of the image forming apparatus 10. The temperature sensor 68, for example, is attached to the housing (not shown) of the image forming apparatus 10. The signal from the temperature sensor 68 is input to the control unit 8.

In this manner, the image forming apparatus 10 forms the color toner image on the surface of the intermediate transfer belt 5 by superimposing and transferring each of the color toner images onto the running intermediate transfer belt 5 using the plurality of image forming parts 1 to 4. Furthermore, the image forming apparatus 10 forms the color image on the printing paper by transferring the color toner image to the printing paper from the intermediate transfer belt 5 using the secondary transfer device 15. Furthermore, other examples of the image forming apparatus 10 include a configuration in which the intermediate transfer belt 5 is used as the transport belt where toner images are directly superimposed and transferred onto the printing paper transported by the transport belt, and a configuration in which a roller shaped intermediate transfer member is used instead of the intermediate transfer belt 5.

Figure 2:
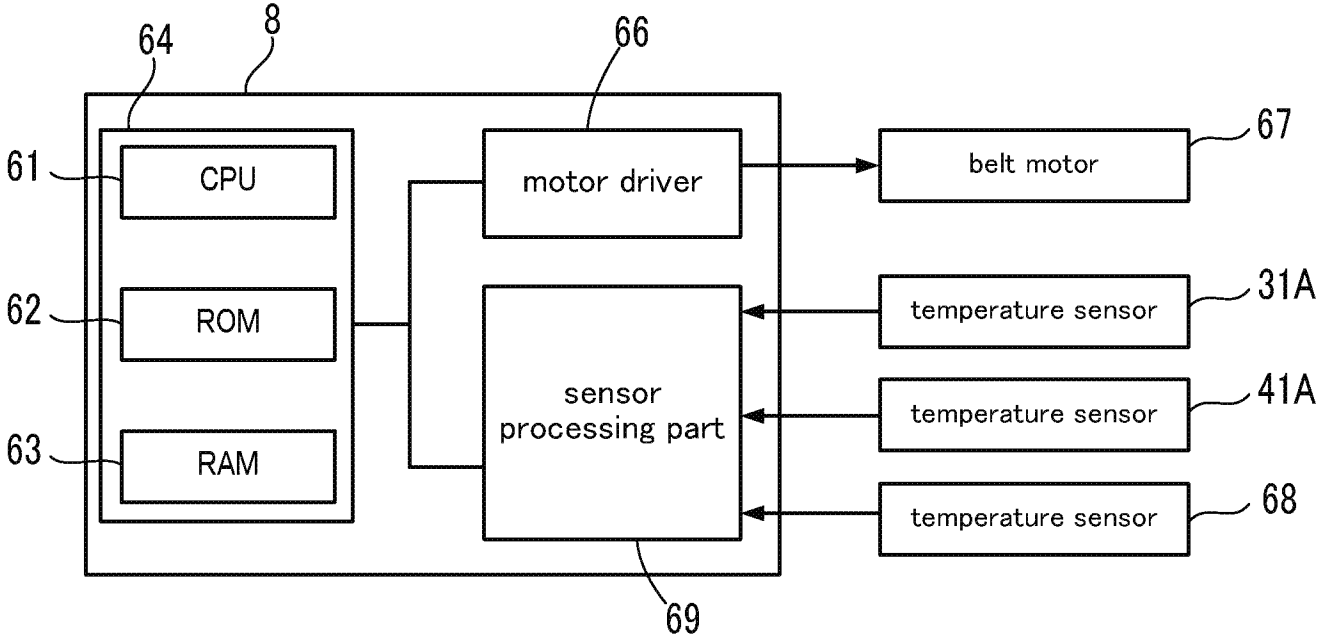
FIG. 2 is a block diagram showing the configuration of a control unit of the image forming apparatus shown in FIG. 1.

The control unit 8 performs overall control of the image forming apparatus 10. As shown in FIG. 2, the control unit 8 is provided with a computation part 64 which has a CPU 61, ROM 62, and RAM 63; a motor driver 66; a sensor processing part 69; and the like. In the computation part 64, a process which follows a predetermined program stored on the ROM 62 is executed by the CPU 61.

In the present embodiment a correction program is stored on the ROM 62. The correction program can correct a slippage (hereinafter referred to as "color slippage") which occurs between each of the toner images when the toner images of each color are superimposed onto the intermediate transfer belt 5. The CPU 61 performs a process of correcting the color slippage (hereinafter referred to as "color slippage correction process") by reading and executing the correction program. The CPU 61, or the control unit 8 provided with the CPU 61 is an example of the correction part in the present disclosure. In addition, a process program which determines the timing to execute the color slippage correction process is stored in the ROM 62. The timing to execute the color slippage correction process is determined by the CPU 61 reading and executing the process program. A procedure of determining the timing will be described later. The color slippage correction process and the timing determination process are not limited to a program being executed by the CPU 61, and, for example, may also be realized using an electronic circuit such as an application specific integrated circuit (ASIC).

The motor driver 66 and the sensor processing part 69, for example, are configured of electronic circuits such as application specific integrated circuits (ASIC) and internal memory or the like. The motor driver 66 is electrically connected to the belt motor 67. The motor driver 66 drive controls the belt motor 67 on the basis of a command signal from the computation part 64. Accordingly, the rotation of the drive roller 7A is controlled and the intermediate transfer belt 5 moves in the direction of an arrow 19. The sensor processing part 69 is electrically connected to the temperature sensors 31A to 34A, the temperature sensors 41A to 44A, and the temperature sensor 68. The sensor processing part 69 converts an output signal input from the temperature sensors 31A to 34A, the temperature sensors 41A to 44A, and the temperature sensor 68 into a digital signal. The computation part 64 calculates a temperature of interiors of the exposure devices 31 to 34 detected by the temperature sensors 31A to 34A, a temperature of interiors of the image-developing devices 41 to 44 detected by the temperature sensors 41A to 44A, and the exterior temperature detected by the temperature sensor 68 on the basis of each of the digital signals converted by the sensor processing part 69. In FIG. 2, a state is shown in which only the temperature sensor 31A, the temperature sensor 41A, and the temperature sensor 68 are connected to the sensor processing part 69, however, other temperature sensors are also connected to the sensor processing part 69. The motor driver 66 and the sensor processing part 69 are not limited to being configured of electronic circuits such as application specific integrated circuits (ASIC), and, for example, may also be realized by the CPU 61 executing a predetermined program.

Figure 3:
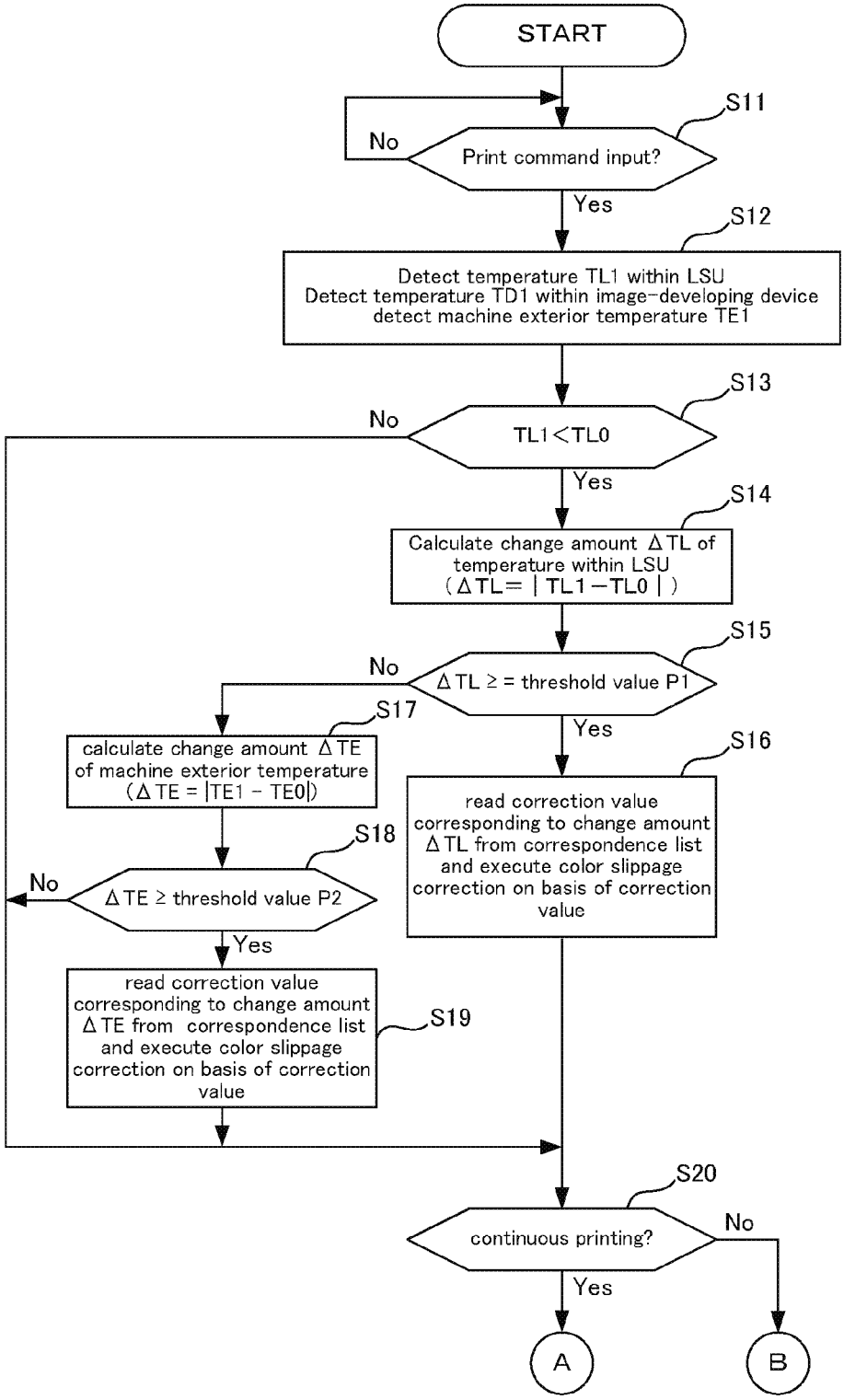
FIG. 3 is a flowchart showing an example of a procedure of determining the execution timing of the color slippage correction executed by the control unit shown in FIG. 2.
Figure 4:
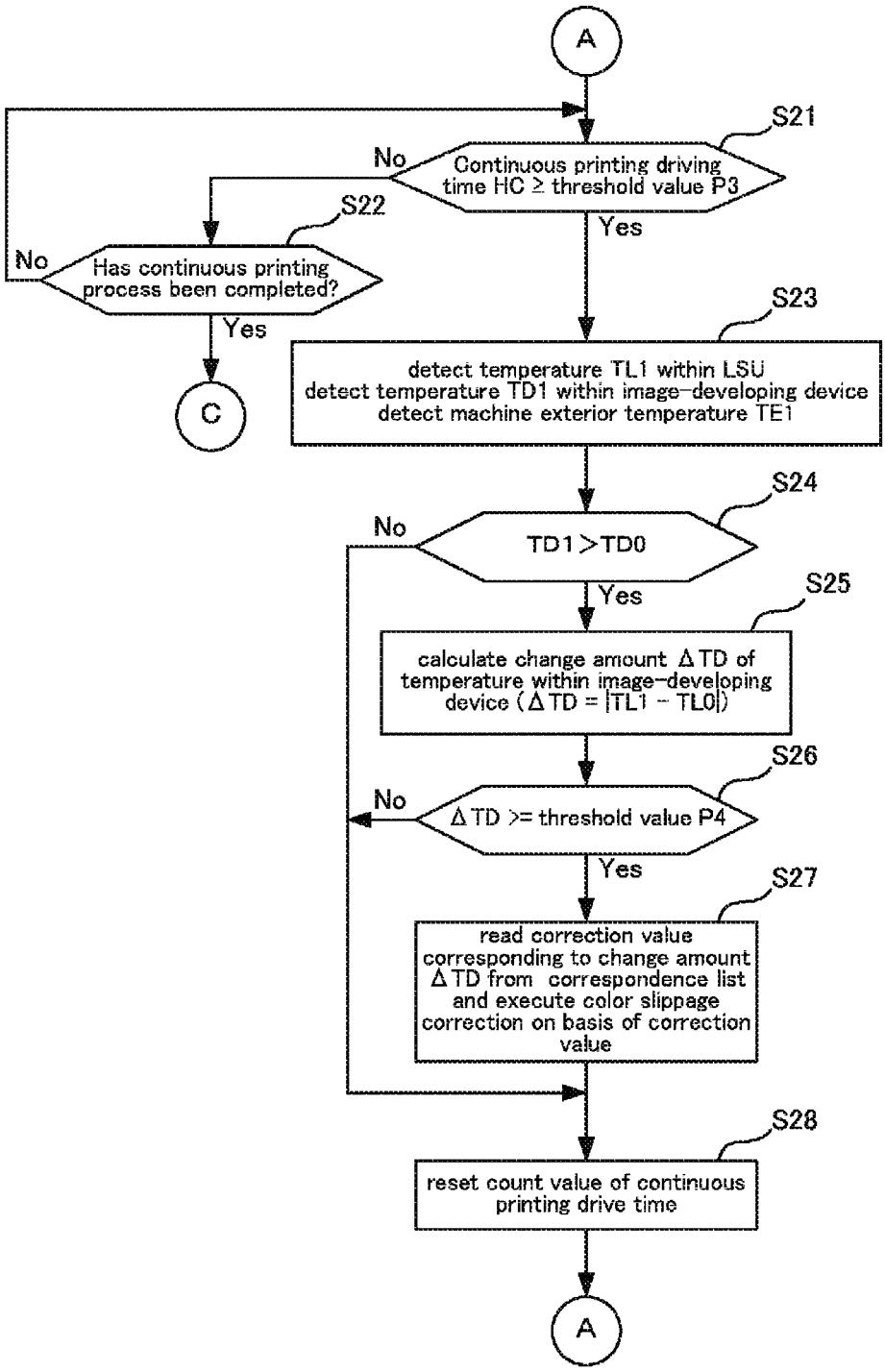
FIG. 4 is a flowchart showing an example of a procedure of determining the execution timing of the color slippage correction executed by the control unit shown in FIG. 2.
Figure 5:
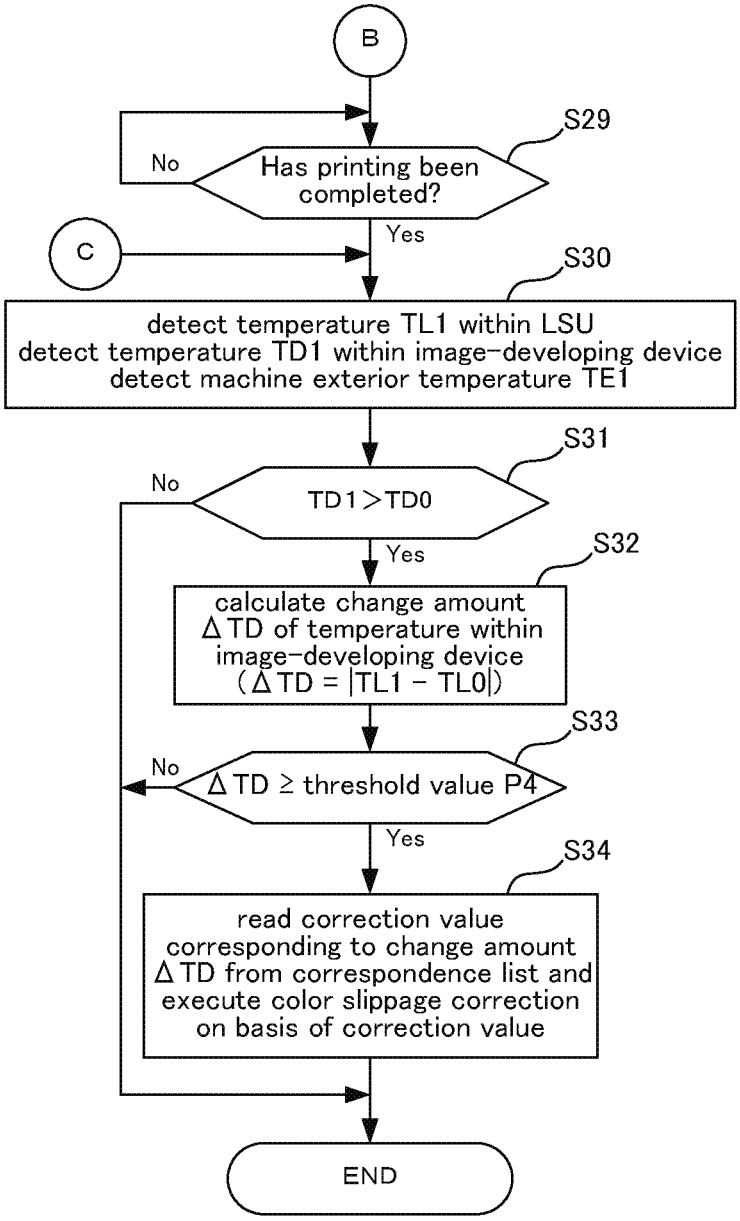
FIG. 5 is a flowchart showing an example of a procedure of determining the execution timing of the color slippage correction executed by the control unit shown in FIG. 2.

Next, description is given, as one example, of the procedure of determining the execution timing of the color slippage correction process executed by the control unit 8, with reference to the flow charts of FIG. 3 to FIG. 5. S11, S12, in FIG. 3 to FIG. 5 represent the numbers of the procedures (steps). The process in each step is performed by the control unit 8. More specifically, the process in each step is performed by the CPU 61 of the computation part 64 executing the program within the ROM 62. Furthermore, the description below is given with the premise that there is a correlative relationship in which when the temperature within the image-processing device 41 elevates, the drive roller 7A and the like expand to cause an increase in the color slippage amount, and that there is a correlative relationship in which when the temperature within the exposure device 31 decreases, the drive roller 7A and the like contract to cause an increase in the color slippage amount.

When a print command is input to the image forming apparatus 10 (S11), the control unit 8 performs detection (measurement) of the temperature of a predetermined location in the interior of the image forming apparatus 10 (S12). Specifically, a temperature TL1 of the interior of the exposure device 31 of the image forming part 1 for black, which is closest to the drive roller 7A, is detected by the temperature sensor 31A. In addition, a temperature TD1 of the interior of the image-developing device 41 of the image forming part 1 for black is detected by the temperature sensor 41A. In addition, a temperature TE1 of the exterior of the image forming apparatus 10 (the exterior temperature of the machine) is detected by the temperature sensor 68. The detection of these temperatures is performed by the CPU 61 performing arithmetic processing on the signals from each of the temperature sensors. The detected information of each of the temperatures is stored in the RAM 63 of the computation part 64. The temperature TL1 corresponds to the third temperature in the present disclosure, and the temperature sensor 31A which detects the temperature TL1 is an example of the second detection part in the present disclosure. In addition, the temperature TD1 corresponds to the first temperature in the present disclosure, and the temperature sensor 41A which detects the temperature TD1 is an example of the first detection part in the present disclosure. In addition, the temperature TE1 corresponds to the fifth temperature in the present disclosure, and the temperature sensor 68 which detects the temperature TE1 is an example of the third detection part in the present disclosure.

Next, in step S13, the control unit 8 compares the temperature TL1 with the temperature TL0 and determines whether the temperature TL1 is lower than the temperature TL0 or not. Here, the temperature TL0 is the temperature detected by the temperature sensor 31A and stored in the RAM 63 earlier than the temperature TL1 is detected in step S12. For example, the temperature TL0 is the temperature within the exposure device 31 detected by the temperature sensor 31A when the color slippage correction is executed in one of the steps S16, S19, S27 or S34 described later, earlier than the temperature TL1 is detected in step S12. The temperature TL0 corresponds to the fourth temperature in the present disclosure. In step S13, the temperature TL1 is determined to be lower than the temperature TL0, the process proceeds to step S14. In addition, in step S13, when the temperature TL1 is determined to be higher than the temperature TL0 the process proceeds to step S20.

In step S13, when the temperature TL1 is determined to be lower than the temperature TL0, the control unit 8 calculates the change amount ΔTL of the temperature within the exposure device 31 by calculating the difference between the temperature TL1 and the temperature TL0 (S14). Subsequently, the control unit 8 determines whether to execute the color slippage correction process or not on the basis of the temperature TL1 and the temperature TL0 (S15). Specifically, the control unit 8 determines whether or not the change amount ΔTL is a predetermined threshold value P1 or more. The threshold value P1 corresponds to the second threshold value in the present disclosure. Here, when the change amount ΔTL is determined to be the threshold value P1 or more, in the next step S16, the control unit 8 reads a correction value corresponding to the change amount ΔTL from a correction value correspondence list (not shown) and executes the color slippage correction process corresponding to the color slippage during temperature decrease using the correction value. Subsequently, the process proceeds to step S20. The correction value correspondence list is a list in which each of the change amounts ΔTL is associated with a correction value, and, for example, is stored in the RAM 63 or the like. When the control unit 8 executes the determination process of step S15, it is an example of the second determination part in the present disclosure.

Meanwhile, in step S15, when the change amount ΔTL is determined to be below the predetermined threshold value P1, the control unit 8 calculates the change amount ΔTE of the exterior temperature of the machine by calculating the difference between the temperature TE1 and the temperature TE0 (S17). Here, the temperature TE0 is the exterior temperature of the machine detected by the temperature sensor 68 and stored in the RAM 63 earlier than the temperature TE1 is detected in step S12. For example, the temperature TE0 is the exterior temperature of the machine detected by the temperature sensor 68 when the color slippage correction process is executed in step S16, or one of the steps S19, S27 or S34 described later, earlier than the temperature TE1 is detected in step S12. The temperature TE0 corresponds to the sixth temperature in the present disclosure.

Next, the control unit 8 determines whether to execute the color slippage correction process or not on the basis of the temperature TE1 and the temperature TE0 (S18). Specifically, the control unit 8 determines whether or not the change amount ΔTE is a predetermined threshold value P2 or more. The threshold value P2 corresponds to the third threshold value in the present disclosure. Here, when the change amount ΔTE is determined to be the threshold value P2 or more, in the next step S19, the control unit 8 reads a correction value corresponding to the change amount ΔTE from a correction value correspondence list (not shown) and executes the color slippage correction process corresponding to the color slippage during temperature decrease using the correction value. Subsequently, the process proceeds to step S20. The correction value correspondence list is a list in which each of the change amounts ΔTE is associated with a correction value, and, for example, is stored in the RAM 63 or the like. In this manner, when the control unit 8 executes the determination process of step S18, it is also an example of the second determination part in the present disclosure.

Furthermore, in step S18, when the change amount ΔTE is determined to be less than the threshold value P2, the process proceeds to step S20.

In step S20, the control unit 8 determines whether or not the content of the input print command is continuous printing. Here, the term continuous printing refers to a print process in which it has been specified that a plurality of pages are to be printed. The control unit 8 can determine whether or not the content of the print command is continuous printing on the basis of the pages to print information contained in the print job data that has been input. In step S20, when the content of the print command is determined to be continuous printing, the process proceeds to step S21 of FIG. 4, and when it is determined not to be continuous printing, the process proceeds to step S29 of FIG. 5. Furthermore, the control unit 8, when a print command of continuous printing has been input, starts counting a drive time HC of the continuous printing process and stores the count value in the RAM 63.

Next, in the next step S21 shown in FIG. 4, the control unit 8 determines whether or not the drive time HC of the continuous printing process is a predetermined threshold value P3 or more. Here, when the drive time HC is determined to be the threshold value P3 or more, the control unit 8 determines that the temperature of the interior of the image forming apparatus 10 has elevated due to a fixed amount of continuous printing being performed. In other words, the control unit 8 determines that the execution conditions of the color slippage correction process have been satisfied and proceeds to the next step S23. Meanwhile, in step S21, when the drive time HC is determined to be less than the threshold value P3, the control unit 8 does not determine that the temperature of the interior of the image forming apparatus 10 has elevated to an extent that color slippage correction should be performed due to a fixed amount of continuous printing not being performed. In this case, the process proceeds to step S22. In step S22, when it is determined that the continuous printing process has completed, the process proceeds to step S30 of FIG. 5. In the present embodiment, in step S21, the control unit 8 performs determination by comparing the drive time HC and the threshold value P3, however, for example, the control unit 8 may also count the pages of the continuous printing process and determine whether or not the count number is a predetermined threshold value or more.

In step S21, when the drive time HC is determined to be the threshold value P3 or more, the control unit 8 performs detection (measurement) of the temperature of a predetermined location in the interior of the image forming apparatus 10 (S23). Specifically, in the same manner as in step S12 described above, the temperature TL1 of the interior of the exposure device 31 of the image forming part 1 for black is detected by the temperature sensor 31A. In addition, a temperature TD1 of the interior of the image-developing device 41 of the image forming part 1 for black is detected by the temperature sensor 41A. In addition, a temperature TE1 of the exterior of the image forming apparatus 10 (the exterior temperature of the machine) is detected by the temperature sensor 68.

Next, in step S24, the control unit 8 compares the temperature TD1 with a temperature TD0 and determines whether the temperature TD1 is higher than the temperature TD0 or not. Here, the temperature TD0 is the temperature detected by the temperature sensor 41A and stored in the RAM 63 earlier than the temperature TD1 is detected in step S23. For example, the temperature TD0 is the temperature within the image-developing device 41 (for example, the temperature detected in step S12) detected by the temperature sensor 41A when the color slippage correction process is executed in steps S16, S19, or the like, earlier than the temperature TD1 is detected in step S23. The temperature TD0 corresponds to the second temperature in the present disclosure. In step S24, when the temperature TD1 is determined to be higher than the temperature TD0, the process proceeds to step S25, and when the temperature TD1 is determined to be lower than the temperature TD0, the process proceeds to step S28.

In step S24, when the temperature TD1 is determined to be higher than the temperature TD0, the control unit 8 calculates the change amount ΔTD of the temperature within the image-developing device 41 by calculating the difference between the temperature TD1 and the temperature TD0 (S25). Subsequently, the control unit 8 determines whether to execute the color slippage correction process or not on the basis of the temperature TD1 and the temperature TD0 (S26). Specifically, the control unit 8 determines whether or not the change amount ΔTD is a predetermined threshold value P4 or more. The threshold value P4 corresponds to the first threshold value in the present disclosure. Here, when the change amount ΔTD is determined to be the threshold value P4 or more, in the next step S27, the control unit 8 reads a correction value corresponding to the change amount ΔTD from a correction value correspondence list (not shown) and executes the color slippage correction process corresponding to the color slippage during temperature elevation using the correction value. Subsequently, the process proceeds to step S28. The correction value correspondence list is a list in which each of the change amounts ΔTD is associated with a correction value, and, for example, is stored in the RAM 63 or the like. In this manner, when the control unit 8 executes the determination process of step S26, it is an example of the first determination part in the present disclosure.

Meanwhile, in step S26, when the change amount ΔTD is determined to be below the predetermined threshold value P4, in step S28, the control unit 8 resets the count value of the drive time HC of the continuous printing process, and repeats the processes of step S21 onward until the continuous printing process is completed.

Next, in the next step S29 shown in FIG. 5, when the printing process is determined to be completed, the control unit 8 performs detection (measurement) of the temperature of a predetermined location in the interior of the image forming apparatus 10 (S30). Specifically, in the same manner as in steps S12 and S23 described above, the temperature TL1 of the interior of the exposure device 31 of the image forming part 1 for black is detected by the temperature sensor 31A. In addition, a temperature TD1 of the interior of the image-developing device 41 of the image forming part 1 for black is detected by the temperature sensor 41A. In addition, a temperature TE1 of the exterior of the image forming apparatus 10 (the exterior temperature of the machine) is detected by the temperature sensor 68.

Next, in step S31, the control unit 8 compares, once again, the temperature TD1 with the temperature TD0 and determines whether the temperature TD1 is higher than the temperature TD0 or not. For example, the temperature TD0 is the temperature within the image-developing device 41 (for example, the temperature detected in step S12 or S23) detected by the temperature sensor 41A when the color slippage correction process is executed in steps S16, S19, S27, or the like, earlier than the temperature TD1 is detected in step S30. In step S31, when the temperature TD1 is determined to be higher than the temperature TD0, the same processes as in steps S26 to S28 are performed in steps S32 to S34 and the series of processes is completed. In step S31, when the temperature TD1 is determined to be lower than the temperature TD0, the series of processes is completed without the processes of steps S32 to S34 being performed.

Description will be given of an example of the effects of the present embodiment. In the image forming apparatus 10 according to the present embodiment, the color slippage mainly caused by inconsistencies in the movement speed of the intermediate transfer belt 5, which occurs due to temperature changes, is corrected at an appropriate timing by using the temperature sensor 41A provided in the image-developing device 41 and the temperature sensor 31A provided in the exposure device 31. Below, a detailed description is given of an example of the effects of the present embodiment.

For example, in the image forming apparatus 10 of a configuration in which the intermediate transfer belt 5 that is an example of the endless transfer belt is suspended by the drive roller 7A and the driven roller 7B that are an example of the plurality of rotating bodies, there are cases in which the intermediate transfer belt 5, the drive roller 7A, and the driven roller 7B expand and contract according to the change in the temperature of the environment. In this case, inconsistencies occur in the movement speed of the intermediate transfer belt 5. These inconsistencies in the movement speed cause a difference between the movement amount of the intermediate transfer belt 5 and the movement amount of the photosensitive drum 11. As a result, when the toner images on the photosensitive drums 11 to 14 are sequentially transferred onto the intermediate transfer belt 5, the transfer timing of each of the toner images shifts, causing color slippage.

Of the drive roller 7A and the driven roller 7B, the drive roller 7A which is positioned in the proximity of the secondary transfer device 15 is close to the fuser device 16. Therefore, the drive roller 7A is apt to receive the influence of the fuser device 16 and expand and contract. In addition, when the intermediate transfer belt 5 is folded back in the proximity of the secondary transfer device 15, the portion of the intermediate transfer belt 5 which passes the proximity of the secondary transfer device 15 is apt to receive the influence of the fuser device 16 and expand and contract. Naturally, the heat source on the interior of the image forming apparatus 10 is not limited to the fuser device 16, and, for example, the polygon motor provided within the exposure device 31, the motor which rotates the drive roller 7A, and the like are also examples of the heat source. However, the drive roller 7A and the intermediate transfer belt 5 are most influenced by the fuser device 16 in terms of heat. Therefore, it is preferable that the timing to correct the color slippage be determined by the temperature of the proximity of the drive roller 7A which is closest to the fuser device 16 being observed. However, since a mechanism of transporting the secondary transfer device 15 and the printing paper, a transmission mechanism which drives the drive roller 7A, and the like are provided in the periphery of the drive roller 7A, there is no space in the periphery of the drive roller 7A to arrange a new temperature sensor. In addition, even if there were such a space, it would be necessary to adopt an expensive highly heat resistant temperature sensor in order to detect the temperature of the periphery of the drive roller 7A, which would lead to a rise in costs.

Meanwhile, the image forming apparatus 10 is provided with the temperature sensor 41A which can detect the temperature of the interior of the image-developing device 41, and the temperature sensor 31A which can detect the temperature of the interior of the exposure device 31. These temperature sensors 31A and 41A are, for example, provided for the purpose of ascertaining the temperature conditions of the periphery of the toner inside the image-developing device 41, or for the purpose of preventing the interior of the exposure device 31 from reaching a high temperature. The applicant of the present application has performed various tests in relation to whether or not these temperature sensors 31A and 41A can be used to determine the appropriate timing for the color slippage correction. As a result, the present applicant discovered that there is a correlative relationship in which when the temperature of the interior of the image-processing device 41 elevates, the color slippage amount increases, and that there is a correlative relationship in which when the temperature of the interior of the exposure device 31 decreases, the color slippage amount increases.

In the present embodiment, since the image forming apparatus 10 is configured as described above, whether or not to perform the color slippage correction process in relation to the color slippage during temperature decrease is determined by the control unit 8 on the basis of the temperature TL1 of the interior of the exposure device 31 and the temperature TL0 detected earlier than the temperature TL1. In addition, whether or not to perform the color slippage correction process in relation to the color slippage during temperature elevation is determined by the control unit 8 on the basis of the temperature TD1 of the interior of the image-developing device 41 and the temperature TD0 detected earlier than the temperature TD1. As described above, there is a correlative relationship between the temperature and the color slippage amount within the image-processing device 41, in which when the temperature within the image-processing device 41 elevates, the drive roller 7A and the like expand to cause an increase in the color slippage amount. In addition, there is a correlative relationship between the temperature and the color slippage amount within the exposure device 31, in which when the temperature within the exposure device 31 decreases, the drive roller 7A and the like contract to cause an increase in the color slippage amount. Therefore, the timing of the color slippage correction process can be appropriately determined by the determination process described above being performed by the control unit 8 using the existing temperature sensors 31A and 41A that are provided in the exposure device 31 and the image-developing device 41, respectively.

In addition, in the present embodiment, the temperature TL1 and the temperature TL0 within the exposure device 31 are compared, and the color slippage correction process is executed only when the temperature TL1 is lower than the temperature TL0. In other words, the execution timing of the color slippage correction process is determined only when the temperature within the exposure device 31 is decreased.

In addition, in the present embodiment, the color slippage correction process is executed when the change amount ΔTL is the threshold value P1 or more. Accordingly, since the color slippage correction process is not executed when the change amount ΔTL is less than the threshold value P1, unnecessary correction is effectively prevented.

Furthermore, even if the change amount ΔTL is less than the threshold value P1, the temperature within the exposure device 31 is decreased, and further, when the change amount ΔTE of the exterior temperature of the machine is the threshold value P2 or more, the color slippage amount during temperature decrease is great. Therefore, when the change amount ΔTE is the threshold value P2 or more, the color slippage correction process is executed in relation to the color slippage during temperature decrease within the exposure device 31.

In addition, in the present embodiment, the temperature TD1 and the temperature TD0 within the image-developing device 41 are compared, and the color slippage correction process is executed only when the temperature TD1 is higher than the temperature TD0. In other words, the execution timing of the color slippage correction process is determined only when the temperature within the image-developing device 41 is elevated.

In addition, in the present embodiment, the color slippage correction process is executed when the change amount ΔTD is the threshold value P4 or more. Accordingly, since the color slippage correction process is not executed when the change amount ΔTD is less than the threshold value P4, unnecessary correction is effectively prevented.

Furthermore, in the embodiment described above, an example is shown in which the timing of the color slippage correction process is determined using the existing temperature sensors 31A and 41A that are provided in the exposure device 31 and the image-developing device 41, respectively, however, for example, the determination process described above may also be performed by the control unit 8 on the basis of each of the temperatures detected by all of the temperature sensors 31A to 34A provided in the exposure devices 31 to 34, and all of the temperature sensors 41A to 44A provided in the image-developing devices 41 to 44. In addition, the determination process described above may also be performed by the control unit 8 on the basis of the temperature detected by any one of the temperature sensors selected from the plurality of temperature sensors. In addition, the determination process described above may also be performed by the control unit 8 on the basis of the average value of the temperatures detected by the temperature sensors 31A to 34A and the temperature sensors 41A to 44A.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a plurality of image carriers arranged in parallel, an exposure device that exposes each of the plurality of image carriers, an image-developing device that forms a toner image on the plurality of respective image carriers which have been exposed using the exposure device, a correction part that corrects for color slippage in the toner image of a plurality of colors that have been sequentially transferred onto a moving transfer target from the plurality of respective image carriers, a first detection part that detects a temperature of an interior of the image-developing device, wherein a first temperature is a temperature detected by the first detection part either when a fixed amount of continuous printing is performed or when printing has completed, and a second temperature is a temperature detected earlier than the first temperature by the first detection part when the correction is performed before the detection of the first temperature, a second detection part that detects a temperature of an interior of the exposure device, wherein a third temperature is a temperature detected by the second detection part when a print command is input, and a fourth temperature is a temperature detected earlier than the third temperature by the second detection part when the correction is performed before the input of the print command, a third detection part that detects a temperature of an exterior of the image forming apparatus, a first determination part that determines that the correction with respect to color slippage during temperature elevation is to be carried out, when the first temperature is higher than the second temperature and a temperature difference between the first temperature and the second temperature is a predetermined first threshold value or more, and a second determination part that determines that the correction with respect to color slippage during temperature decrease is to be carried out, when the third temperature is lower than the fourth temperature and a temperature difference between the third temperature and the fourth temperature is less than a second threshold value, and the temperature difference between a fifth temperature detected by the third detection part and a sixth temperature detected by the third detection part earlier than the fifth temperature is a predetermined third threshold value or more.

2. An image forming apparatus comprising:

a plurality of image carriers arranged in parallel, an exposure device that exposes each of the plurality of image carriers, an image-developing device that forms a toner image on the plurality of respective image carriers which have been exposed using the exposure device, a correction part that corrects for color slippage in the toner image of a plurality of colors that have been sequentially transferred onto a moving transfer target from the plurality of respective image carriers, a first detection part that detects a temperature of an interior of the image-developing device, a second detection part that detects a temperature of an interior of the exposure device, a third detection part that detects the temperature of the exterior of the image forming apparatus, a first determination part that determines that the correction with respect to color slippage during temperature elevation is to be carried out, when a first temperature detected by the first detection part is higher in temperature than a second temperature detected by the first detection part earlier than the first temperature, and the a temperature difference between the first temperature and the second temperature is a predetermined first threshold value or more, and a second determination part that determines that the correction with respect to color slippage during temperature decrease is to be carried out, when a third temperature detected by the second detection part is lower in temperature than a fourth temperature detected by the second detection part earlier than the third temperature, and a temperature difference between the third temperature and the fourth temperature is less than a second threshold value, and a temperature difference between a fifth temperature detected by the third detection part and a sixth temperature detected by the third detection part earlier than the fifth temperature is a predetermined third threshold value or more.

3. An image forming apparatus comprising:

a plurality of image carriers arranged in parallel, an exposure device that exposes each of the plurality of image carriers, an image-developing device that forms a toner image on the plurality of respective image carriers which have been exposed using the exposure device, a correction part that corrects for color slippage in the toner image of a plurality of colors that have been sequentially transferred onto a moving transfer target from the plurality of respective image carriers, a first detection part that detects a temperature of an interior of the image-developing device, a second detection part that detects a temperature of an interior of the exposure device, a third detection part that detects the temperature of the exterior of the image forming apparatus, a first determination part that determines whether or not the correction with respect to color slippage during temperature elevation is to be carried out, on the basis of a first temperature detected by the first detection part and a second temperature detected by the first detection part earlier than the first temperature, when the first temperature is higher than the second temperature, and a second determination part that determines that the correction with respect to color slippage during temperature decrease is to be carried out, when a third temperature detected by the second detection part is lower in temperature than a fourth temperature detected by the second detection part earlier than the third temperature, and a temperature difference between the third temperature and the fourth temperature is less than a first threshold value, and the temperature difference between a fifth temperature detected by the third detection part and a sixth temperature detected by the third detection part earlier than the fifth temperature is a predetermined second threshold value or more.

* * * * *